US005081840A

United States Patent [19]

Landon

[11] Patent Number: 5,081,840

[45] Date of Patent: Jan. 21, 1992

[54] SPOOL VALVE AND PISTON POWER PLANT

[76] Inventor: Hank A. Landon, 4412 Mayflower La., Las Vegas, Nev. 89107

[21] Appl. No.: 462,646

[22] Filed: Jan. 9, 1990

[51] Int. Cl.[5] ..... F01B 1/06; F01B 13/14

[52] U.S. Cl. ..... 60/500; 91/477; 91/496

[58] Field of Search ..... 60/398, 497, 500; 91/474, 477, 476, 496, 184, 189 A

[56] References Cited

U.S. PATENT DOCUMENTS

| | | | |
|---|---|---|---|
| 46,470 | 2/1865 | Hicks | 91/477 |
| 310,369 | 1/1885 | Bown | 91/184 |
| 654,127 | 7/1900 | Billetop | 91/477 X |
| 1,183,412 | 5/1916 | Valente | 91/496 |
| 2,131,729 | 10/1938 | Fee | 91/477 X |
| 2,931,312 | 4/1960 | Donner | 91/477 |
| 3,150,603 | 9/1964 | Yarger | 91/477 |
| 3,255,707 | 6/1966 | Platt | 91/477 |
| 4,013,382 | 3/1977 | Diggs | 60/398 X |
| 4,210,821 | 7/1980 | Cockerell | 60/500 X |
| 4,580,400 | 4/1986 | Watabe et al. | 60/398 |
| 4,698,969 | 10/1987 | Raichlen et al. | 60/398 X |

FOREIGN PATENT DOCUMENTS 888206 7/1949 Fed. Rep. of Germany ..... 91/477

*Primary Examiner*—Edward K. Look
*Assistant Examiner*—George Kapsalas
*Attorney, Agent, or Firm*—Quirk, Tratos & Roethel

[57] ABSTRACT

This power plant utilizes a multi-cylinder hydraulic engine that has a plurality of pistons and cylinders arranged for reciprocal movement. Each piston is powered by a hydraulic fluid or air pressure. The fluid exhausted from one cylinder is sent to another cylinder to act as the inlet fluid to move that cylinder. The engine requires piston and cylinder arrangements in sets or multiples of four (such as 4, 8, 12, 16 and so forth) to provide a balanced system. The engine can be designed in many different arrangements such as four cylinder in line, four cylinder radial, eight cylinder radial, eight cylinder V-shaped, eight cylinder opposed and so forth. These cylinder arrangements can be linked together if desired to provide multiple engine power plants. The piston used in the present invention is a spool-type piston having distinct sections which create distinct upper and lower fluid areas in the cylinder. The hydraulic engine can be coupled in a power plant arrangement with a source of fluid pressure such as a pump arrangement located on pontoons on a body of water subject to tidal or wave movements.

18 Claims, 7 Drawing Sheets

SPOOL VALVE AND PISTON POWER PLANT

BACKGROUND OF THE INVENTION

This invention relates to a spool valve and piston power plant, and more particularly to a spool valve and piston power plant that converts reciprocal power from an hydraulic ram into rotary power.

There have been many types of power plants proposed using many different types of power sources. In recent years, internal combustion engines and electrical engines have been predominant due to the relative inexpense of fossil fuel to power these engines. Because fossil fuel is not inexhaustible and because environmental concerns are becoming increasingly important, alternative sources of power are needed. For example, there have been proposals to use the movement of tides and waves as a source to power engines and power plants.

Hydraulic pumps have also been known for many years. It is also conventional to use fluid pressure to control the movement of a piston back and forth in a cylinder. Fluid pressure is particularly appealing because the kinetic characteristics of fluids have been studied and analyzed quite thoroughly by engineers and the resulting effects are quite predictable. There are many neutral fluids, such as water, that can be used in an hydraulic pump without raising any environmental or safety concerns.

It is an object of the present invention to provide a power plant that is very efficient, that can be built of inexpensive materials and that can utilize as an energy source the tidal or wave movement available in large bodies of water.

It is a feature of the present invention to utilize a multi-cylinder hydraulic fluid or air pressure engine that utilizes fluid pressure to move the pistons in a reciprocal movement inside a cylinder and which converts this reciprocal movement to rotary movement which turns a drive shaft to generate energy that can be used for many worthwhile purposes. It is another feature of the present invention to utilize a spool-type piston to provide two distinct chambers within the cylinder.

It is an advantage of the present invention that an efficient and inexpensive source of power can be made available using the tidal or wave movement of large bodies of water, that such source of energy is environmentally safe and that no dangerous or deleterious by-products are created.

SUMMARY OF THE INVENTION

This power plant includes a multi-cylinder hydraulic fluid or air pressure engine that has a plurality of pistons and cylinders arranged for reciprocal movement. Each piston is powered by a fluid material, such as water or air. The fluid from a reservoir or pump is delivered to an upper chamber in each cylinder. During the downstroke of the piston, the fluid exhausted from one cylinder is sent to another cylinder to act as the inlet fluid to move a piston in that cylinder. During the upstroke of a piston, fluid is returned from the other cylinder to the lower chamber of the first cylinder. Finally, the fluid in the lower chamber of the first cylinder is exhausted back to the reservoir or pump to complete the cycle. This engine requires piston and cylinder arrangements in sets or multiples of four (such as 4, 8, 12, 16 and so forth) to provide a balanced system. This engine can be designed in many different arrangements such as four cylinder in line, four cylinder radial, eight cylinder radial, eight cylinder V-shaped, eight cylinder opposed and so forth. These cylinder arrangements can be linked together if desired to provide multiple engine power plants.

The engine body that houses the piston and cylinder arrangements can be made of a multitude of materials. Traditional metal engine materials can be used such as cast iron, stainless steel, brass or aluminum. Nonmetallic materials are also appropriate such as fiberglass, plastic, glass, ceramic or wood. Depending on the size of the engine desired, it is only necessary that the engine material be able to withstand the pressure of the fluid flowing through the system. If water or air are used as the fluid, there is no toxicity problem that must be considered in the selection of the engine material. Since fluid pressure is the motive force in the movement of the pistons, there is no heat or explosive forces to contend with such as would be present in a conventional internal combustion engine.

The piston used in the present invention is a spool-type piston having distinct sections which create distinct upper and lower fluid chambers in the cylinder.

The various engine configurations of the present invention can be utilized in a power plant arrangement that utilizes the movement of tides or waves as the motive force to pump the fluid through the engine or to a storage reservoir for later use in the engine. A pump arrangement can be disposed on pontoons on the surface of the body of water and the movement of the body of water due to tides or waves is translated by the pontoons and the pump arrangement into a source of fluid pressure which is eventually used to power the hydraulic engine.

DETAILED DESCRIPTION OF THE PREFERRED EMBODIMENTS

Figure 1:
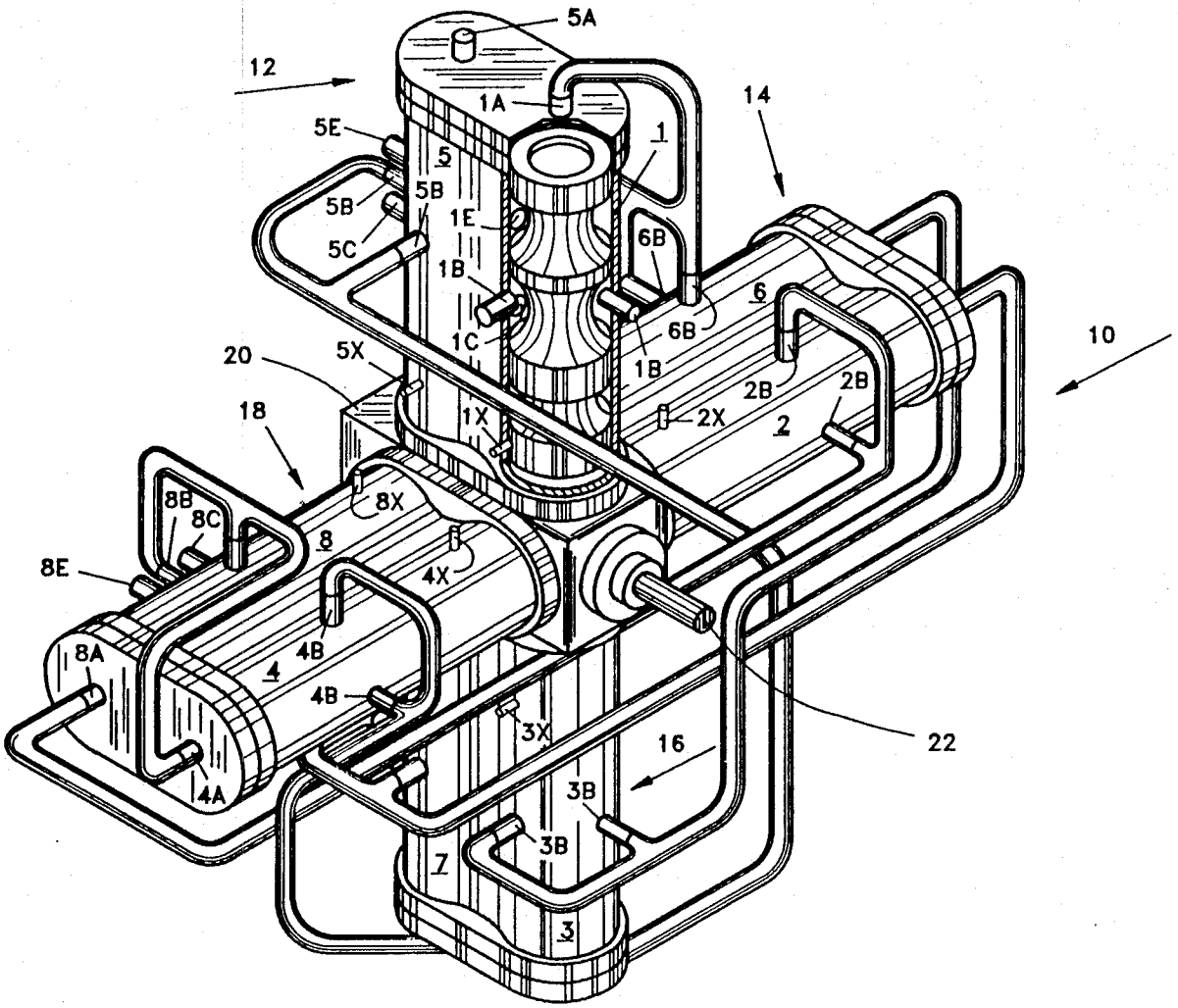
FIG. 1 shows a schematic diagram of an eight cylinder radial engine of the present invention.
Figure 2A:
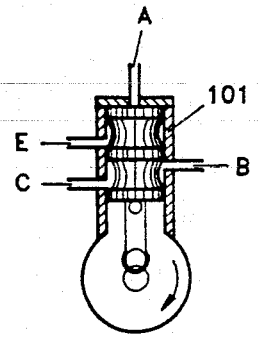
FIGS. 2 A–D through 5 A–D show sequentially the positions of the pistons during the operation of a four cylinder engine of the present invention.
Figure 2B:
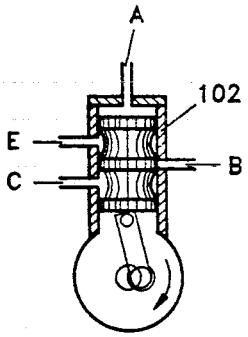
Figure 2C:
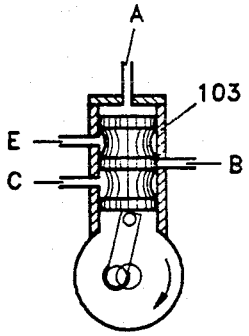
Figure 2D:
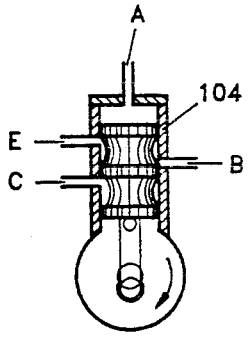
Figure 3A:
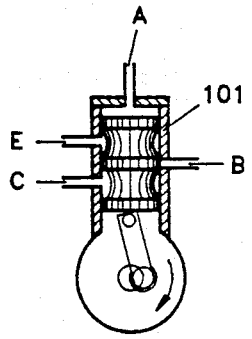
Figure 3B:
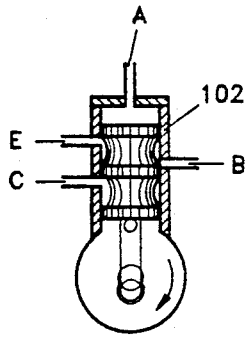
Figure 3C:
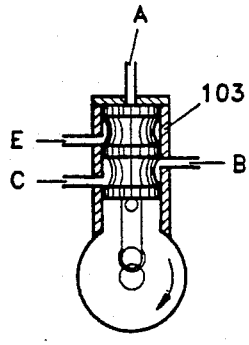
Figure 3D:
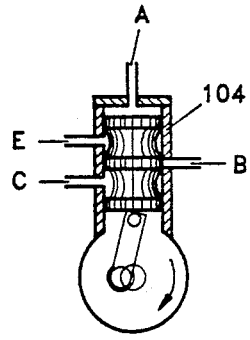
Figure 4A:
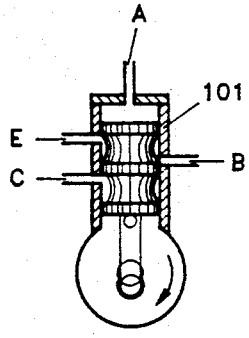
Figure 4B:
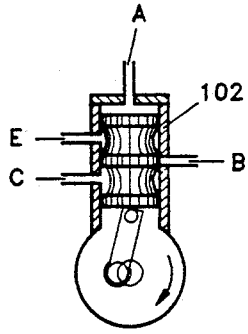
Figure 4C:
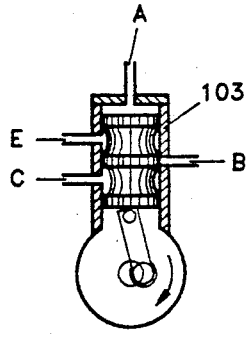
Figure 4D:
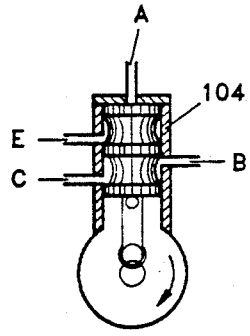
Figure 5A:
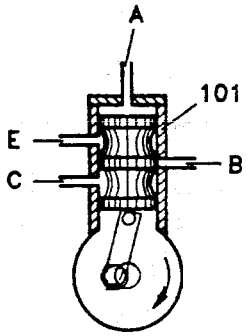
Figure 5B:
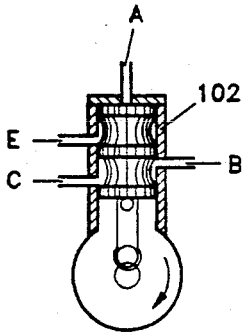
Figure 5C:
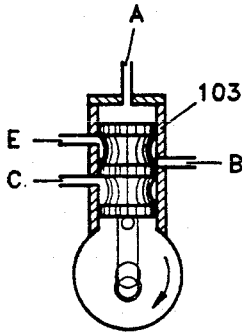
Figure 5D:
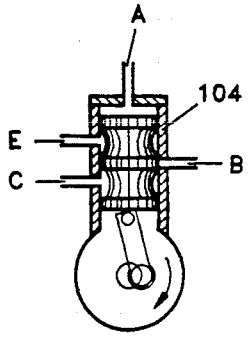

An eight cylinder radial hydraulic engine of the present invention is shown generally at 10 in FIG. 1. The engine comprises four cylinder housings 12, 14, 16, and 18, each containing two pistons arranged in parallel. Various inlet and outlet ports are provided in each cylinder housing to allow the transfer of fluid into and out of each cylinder housing. Fluid conduit lines (only some of which are shown in FIG. 1 for clarity) connect the various ports together so that the cylinder housings are in fluid communication with each other.

Each cylinder housing is mounted around the perimeter of a crankshaft housing 20. The end of each of the eight pistons is joined to the crankshaft (not shown) within the crankshaft housing 20. The crankshaft converts the reciprocal motion of each of the pistons to rotary motion that turns the drive shaft 22. The rotation of the driveshaft 22 can be used in any conventional manner to produce work.

Each cylinder has ports identified as A, B, C and E. Port A is an inlet/outlet port for each cylinder and is located in the cylinder head. Port B identifies the ports used to allow fluid to flow from and to a port A. The ports B from one cylinder connect to a port A on an alternate cylinder. The fluid in the conduit lines between a port A and the associated ports B will flow in different directions at different times during the cycle of the piston.

On the downstroke (power stroke) of the piston, fluid under pressure flows from ports B into a port A forcing the piston down and effecting the power to the crankshaft to produce the work that can be eventually realized from the driveshaft. On the upstroke of the piston, the fluid flow reverses with the fluid flowing from a port A into ports B to assist in the upstroke.

Port C is the exhaust port for each cylinder and all cylinders are linked together through their respective port C's to an exhaust manifold and fluid from each port C is returned to the storage reservoir.

Port E is the inlet port for each cylinder and fluid under pressure is connected to a port E on each cylinder by use of an intake manifold linking all cylinders together through their respective port E's.

Each cylinder is also provided with a pair of Ports X through which a lubricating medium is provided to the piston to provide for lubrication of some of the internal seals inside the cylinder, as will be more fully explained in connection with the description of FIG. 6.

The arrangement of fluid conduit lines interconnecting the various cylinders will now be explained in connection with describing the operation of the hydraulic engine shown in FIG. 1. Cylinder housing 12 contains in parallel relationship cylinder 1 and cylinder 5. Cylinder 1 is fed by cylinder 6 and cylinder 1 in turn feeds cylinder 5.

At the beginning of the downstroke of cylinder 1, fluid enters the top of cylinder 1 through port 1A from ports 6B. This fluid begins to push cylinder 1 down which in addition to turning the crankshaft also exhausts fluid through ports 1B. The fluid leaving ports 1B is introduced into cylinder 5 through port 5A. At the same time, fluid enters port 1E from cylinder 5 through this same port 1E which is simply an aperture in the wall separating cylinder 1 from cylinder 5.

As the downstroke of cylinder continues, fluid is exhausted through port 1C into the adjoining space in cylinder 5 since port 1C is also simply an aperture in the wall separating cylinder 1 from cylinder 5. At the bottom of the downstroke, the direction of the fluid flows reverses.

The other three cylinder housings operate in a similar manner. Cylinder housing 14 contains cylinder 2 and cylinder 6 in parallel and cylinder 6 is fed by cylinder 3 while cylinder 2 is fed by cylinder 7.

Cylinder housing 16 contains cylinder 3 and cylinder 7 in parallel and cylinder 7 is fed by cylinder 4 while cylinder 3 is fed by cylinder 5.

Cylinder housing 18 contains cylinder 4 and cylinder 8 in parallel and cylinder 4 is fed by cylinder 8 while cylinder 8 is fed by cylinder 2.

FIGS. 2 A–D through FIGS. 5 A–D show sequentially the positions of the pistons during the operation of a four cylinder hydraulic engine of the present invention. The eight cylinder embodiment of the present invention is simply a multiple of the four cylinder embodiment shown in these FIGS. 2 A–D through FIGS. 5 A–D, with the movement of the pistons in the cylinders selected to be in counterbalance; that is, in each cylinder housing having two adjoining pistons (such as cylinders 1 and 5 shown in FIG. 1), one piston will be moving upward when the adjoining piston is moving downward.

In this four cylinder embodiment shown in FIGS. 2 A–D through FIGS. 5 A–D, cylinder 101 feeds cylinder 103, cylinder 103 feeds cylinder 104, cylinder 104 feeds cylinder 102 and cylinder 102 feeds cylinder 101. Similar to the embodiment shown in FIG. 1, each cylinder has four ports identified as A, B, C and E.

FIGS. 2 A–D represent the simultaneous locations of the pistons in cylinders 101, 102, 103 and 104 at a particular point in the cycle. FIGS. 3 A–D represent the simultaneous locations of the pistons in cylinders 101, 102, 103 and 104 at a particular point in the cycle 90° after the point shown in FIG. 2. FIGS. 4 A–D represent the simultaneous locations of the pistons in cylinders 101, 102, 103 and 104 at a particular point in the cycle 90° after the point shown in FIG. 3. Finally, FIGS. 5 A–D represent the simultaneous locations of the pistons in cylinders 101, 102, 103 and 104 at a particular point in the cycle 90° after the point shown in FIG. 4.

In this four cylinder embodiment, when the piston in cylinder 101 is at the top dead center (FIG. 2A), fluid pressure flows from port 102B to port 101A. As the piston begins to move down from the pressure of fluid flowing into port 101A (FIG. 3A), port 101B is starting to feed fluid into cylinder 103 forcing the piston in cylinder 103 down. As the piston in cylinder 101 reaches the bottom of its stroke and begins to start to go back up (FIG. 4A), the piston head forces fluid back out through port 101A and thus back through port 102B through the lower end of cylinder 102 and out port 102C and into the fluid storage reservoir. As the piston in cylinder 101 continues on its upward stroke (FIG. 5A), port 101B opens to allow fluid to flow into the lower end of the cylinder 101 and then out port 101C into the fluid storage reservoir.

While the above cycle is going on in cylinder 101, the same cycle is also occurring in cylinder 102, cylinder 103 and cylinder 104, but each of these cylinders are 90° out of phase with each other as shown in FIGS. 2 A–D through FIGS. 5 A–D.

Table I shows the manner in which the various ports of the four cylinders are interconnected for clockwise rotation of the crankshaft.

TABLE I

| Cylinder 101 | Cylinder 102 | Cylinder 103 | Cylinder 104 |
|---|---|---|---|
| 1-A to 2-B | 2-A to 4-B | 3-A to 1-B | 4-A to 3-B |
| 1-B to 3-A | 2-B to 1-A | 3-B to 4-A | 4-B to 2-A |
| 1-C Exhaust | 2-C Exhaust | 3-C Exhaust | 4-C Exhaust |
| 1-E Inlet Pressure | 2-E Inlet Pressure | 3-E Inlet Pressure | 4-E Inlet Pressure |

Table II shows the manner in which the various ports of the four cylinders are interconnected for counterclockwise rotation of the crankshaft.

TABLE II

| Cylinder 101 | Cylinder 102 | Cylinder 103 | Cylinder 104 |
|---|---|---|---|
| 1-A to 3-B | 2-A to 1-B | 3-A to 4-B | 4-A to 2-B |
| 1-B to 2-A | 2-B to 4-A | 3-B to 1-A | 4-B to 3-A |
| 1-C Exhaust | 2-C Exhaust | 3-C Exhaust | 4-C Exhaust |
| 1-E Inlet Pressure | 2-E Inlet Pressure | 3-E Inlet Pressure | 4-E Inlet Pressure |

This reversing of the direction of the turning of the crankshaft can be achieved by physically reconnecting the conduits connecting the various ports. Alternatively, the reversing can be achieved by using a control valve plumbed into the system that automatically redirects the fluid flow from forward to reverse and vice versa. This control valve can be a spool type valve design.

Figure 6:
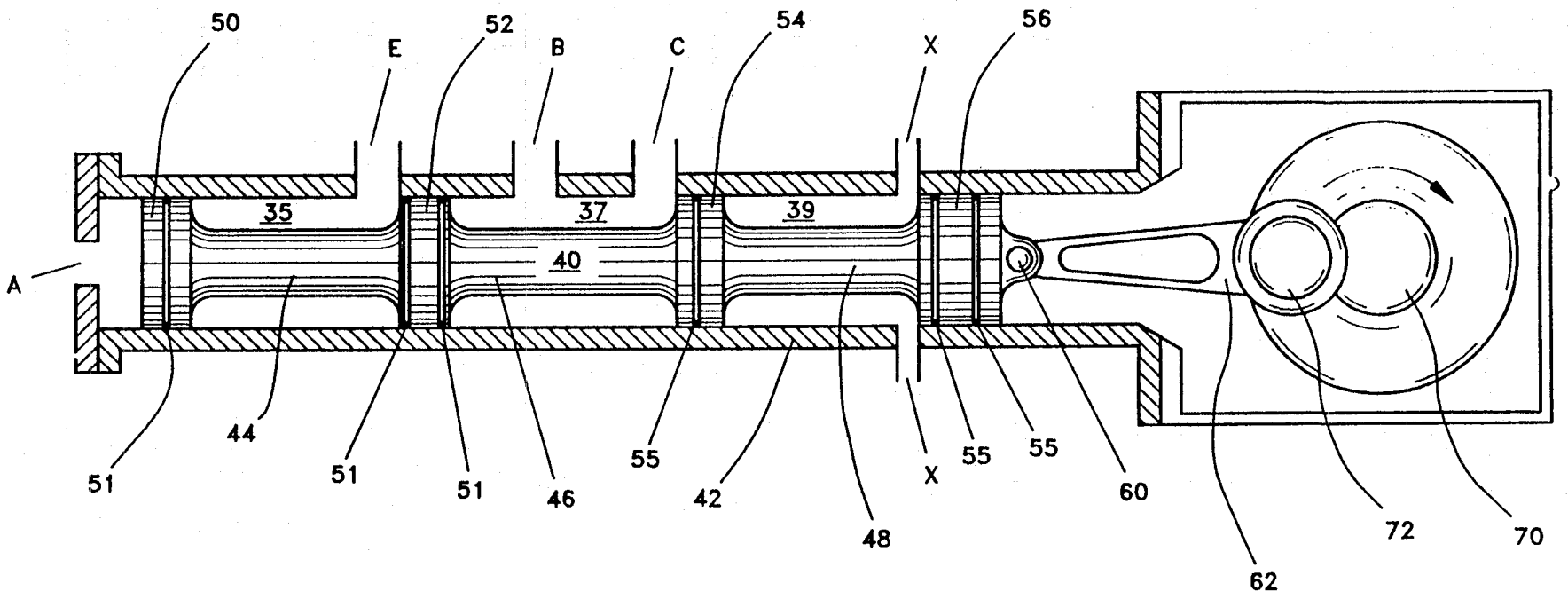
FIG. 6 shows a spool-type piston used in a cylinder of the engine of the present invention.

FIG. 6 shows a spool-type piston of the type used in each of the cylinders shown in FIG. 1. A cylinder 42 is provided with a multi-segment spool-type piston 40. The piston 40 comprises an upper segment 44, a middle segment 46 and a lower segment 48 each of which are separated by sealing members 50, 52, 54 and 56.

The first sealing member 50 acts as the piston head and provides the surface upon which the fluid entering the cylinder through port A can act. A teflon seal 51 located on the first sealing member 50 seals one side of the first sealing member 50 from the other side.

Second sealing member 52 is located along the length of the piston 40 to define an upper chamber 35 which receives fluid from port E. Another set of teflon seals 51 also prevents the fluid entering this upper chamber 35 from leaking out and prevents fluid on the other side of this upper chamber 35 from leaking in. As was shown in connection with the description of FIGS. 2 A–D through FIGS. 5 A–D, this upper chamber 35 is also sometimes in fluid communication with port B.

Third sealing member 54 is located at another position along the length of the piston 40 to define a middle chamber 37 which is in fluid communication with port C. A rubber O-ring seal 55 maintains this middle chamber 37 in fluid isolation from the other adjacent chambers. As was shown in connection with the description of FIGS. 2 A–D through FIGS. 5 A–D, this middle chamber 37 is also sometimes in fluid communication with port B.

The fourth sealing member 56 is located at another position along the length of the piston 40 to define a lower chamber 39 that is in fluid communication with ports X. This fourth sealing member is provided also provided with a set of rubber O-ring seals 55 to ensure that fluid from adjoining chambers will not leak into this lower chamber 39 and that fluid in this lower chamber 39 will not leak into adjoining chambers.

The fourth sealing member 56 also acts the bottom of the piston 40 and is mechanically pivotally connected at wrist pin 60 to an arm 62 which is connected to the connecting rod journal 72 on the crankshaft 70. As the piston 40 reciprocates up and down within the cylinder 42, the arm 62 will cause the crankshaft 70 to rotate. This crankshaft is directly connected to a driveshaft 22 (FIG. 1) to allow the engine of the present invention to perform work.

The positioning of the various sealing members 50, 52, 54 and 56 along the length of piston 40 is determined by the location of the ports E, B and C. At all times during the reciprocating movement of piston 40, port E remains in fluid contact with upper chamber 35 and port C remains in fluid contact with middle chamber 37. The second sealing member 52, however, moves up and down causing port B to sometimes be in fluid contact with upper chamber 35, sometimes in fluid contact with middle chamber 37 and sometimes to be shut off by second sealing member 52.

The pair of Ports X are used to provide lubricating fluid to lower chamber 39. This lubricating fluid, which may be vegetable oil or any other appropriate lubricating fluid, assists in lubricating the rubber O-ring seals 55 and also acts to prevent the fluid contained in middle chamber 37 from being contaminated by the conventional crankcase oil used to lubricate the wrist pin 60, the arm 62, the crankshaft 70 and the connecting rod journal 72. This permits the fluid flowing through ports A, B, C and E that is used to power the piston to be any fluid available under pressure, such as air from a source of air pressure or even water from a municipal or local water supply. The air or water can then be recycled back to its source of supply for other uses since the air or water has not been contaminated by the engine.

Figure 7:
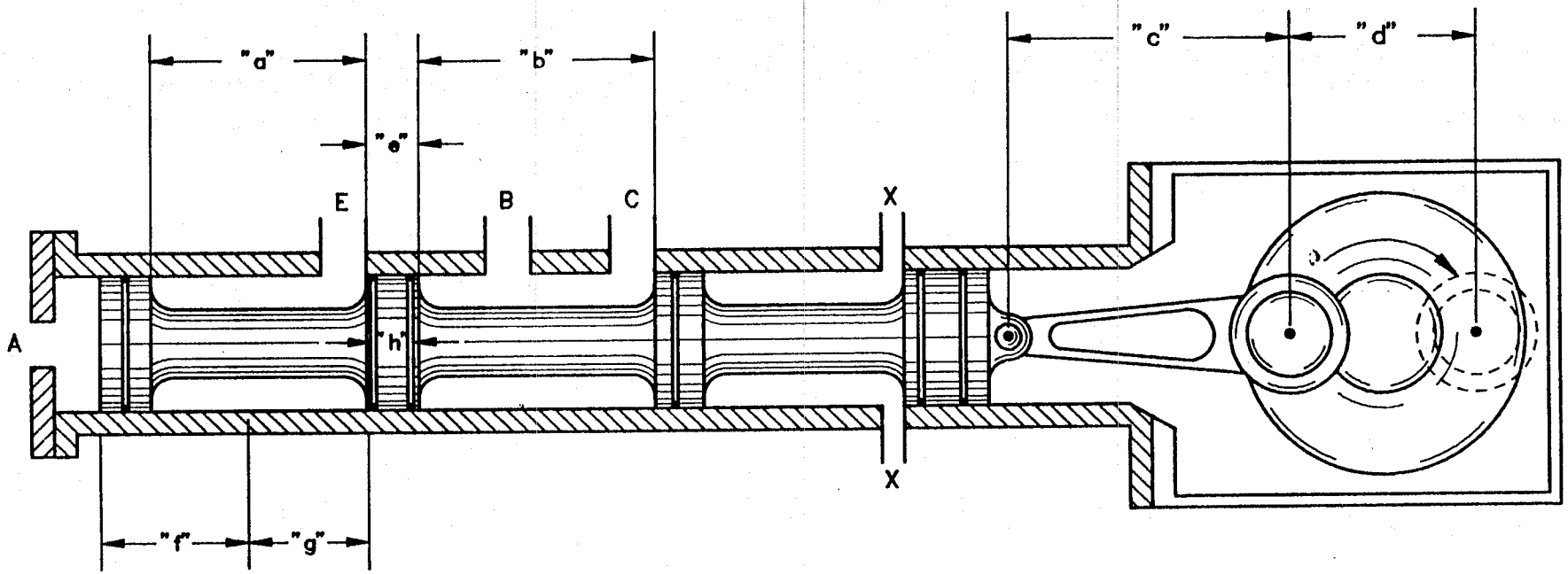
FIG. 7 shows the spool-type piston of FIG. 6 dimensioned to show the size relationship between the various parts.

FIG. 7 shows dimensionally the size relationship between the various parts of the piston and cylinder arrangement shown in FIG. 6. Dimension "d" is the total length of the stroke of the piston and is determined by the diameter distance of the point at which the connecting rod journal is connected to the crankshaft. Dimension is determined by the length of the stroke ("d") plus the diameter of port E. Dimension "e" is determined by the diameter of port E. Dimension "b" is determined by the length of dimension "h" plus the diameters of port B and port C plus the length of the stroke ("d"). Dimension "c" is the length of the arm connecting the bottom of the piston to the connecting rod journal. Dimension "f" is the length of the top half of the stroke and dimension "g" is the length of the bottom half of the stroke. ("f" plus "g" equal "d"). The length of the top half of the stroke is slightly in excess of the length of the bottom half of the stroke.

The dimension "h" is the width of the second sealing member which closes off port B during the stroke of the piston as shown in FIGS. 2 A–D through FIGS. 5 A–D. In the preferred embodiment of this invention, the dimension "h" should be exactly equal to the diameter of the port B.

For example, the following dimensions could be used to construct a piston and cylinder arrangement such as the one shown in FIGS. 6 and 7. Using a stroke length ("d") of 3.5 inches. a cylinder bore of 8.0 inches and port E and C diameters of 2 inches (inner diameter), the dimension "a" would be 5.5 inches. Using a port B diameter of 1.5 inches, the dimension "e" and the dimension "h" would both be 1.5 inches. Dimension "b" would be 8.5 inches. The dimension "c" (the length of the arm) is not critical and can be any suitable length limited only be the physical limitations of the components. Dimension "f" would be approximately 1.85 inches and dimension "g" would be approximately 1.65 inches so that these two dimensions when added together yield the length of the stroke ("d" = 3.5 inches). Dimension "h" would be 1.5 inches, the size of the diameter of port B.

In the preferred embodiment of this invention as shown in FIG. 6, the arm 62 is connected to the wrist pin 60 which is located at the approximate center of the bottom of the piston 40. This design allows the engine to be reversible so that the crankshaft can be turned either clockwise or counter-clockwise.

Alternatively, the wrist pin 60 can be positioned slightly off from the center of the bottom of the piston 40. This design alleviates the potential problem of fluid lock and minimizes the preciseness that would otherwise be necessary as to the size of dimension "h" which closes off port B. Thus the dimension "h" could be approximately 0.010 to 0.030 inches larger than the inner diameter of port B and still be functional. This latitude allows less precision in machining and minimizes the cost of fabrication of the engine. This off center design, however, prevents the engine from being reversible.

Figure 8:
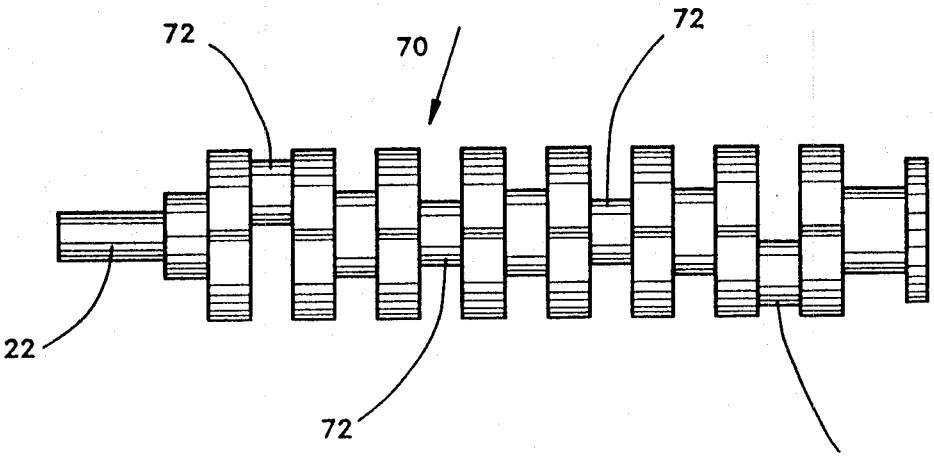
FIG. 8 shows a crankshaft of the type used in the hydraulic engine of the present invention.

FIG. 8 shows a crankshaft 70 of the type used in the hydraulic engine of the present invention. The crankshaft 70 has a plurality of connecting rod journals 72 disposed at points 90° apart about the axis of the crankshaft 70 and offset from the central axis of the crankshaft 70. An arm 62 (FIG. 6) from each piston 40 is connected to each of the connecting rod journals 72 and one end of the crankshaft is directly connected to the driveshaft 22.

Figure 10:
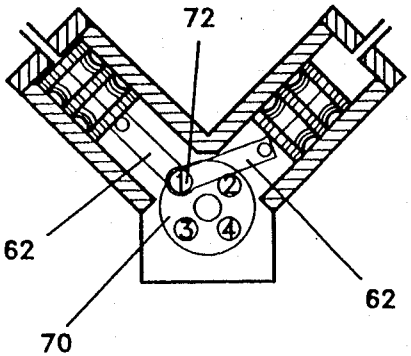
FIGS. 9–11 show alternative multiple-cylinder arrangements of the hydraulic engine of the present invention.
Figure 11:
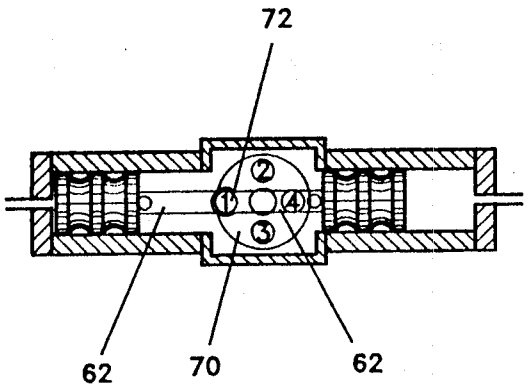
Figure 9:
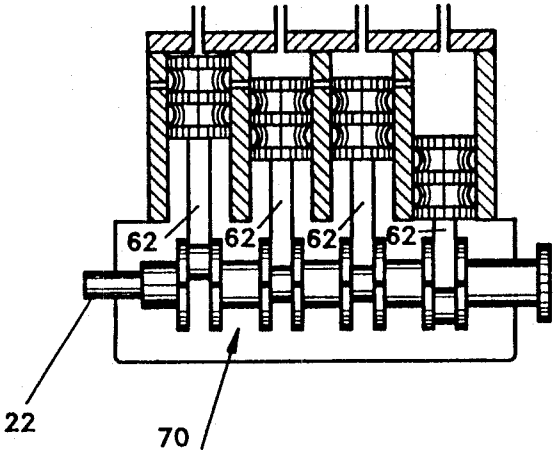

FIG. 9 shows an alternative embodiment of the hydraulic engine of the present invention in which the cylinders are arranged in a four cylinder in line configuration. FIG. 10 shows an alternative embodiment of the hydraulic engine of the present invention in which the cylinders are arranged in a V-8 cylinder configuration. FIG. 11 shows an alternative embodiment of the hydraulic engine of the present invention in which the cylinders are arranged in an eight cylinder opposed configuration. Whenever eight cylinders are used (such as shown in FIGS. 10 and 11), an arm 62 for each of two cylinders is connected to the same connecting rod journal 72 to permit the use of the crankshaft shown in FIG. 8.

Figure 12:
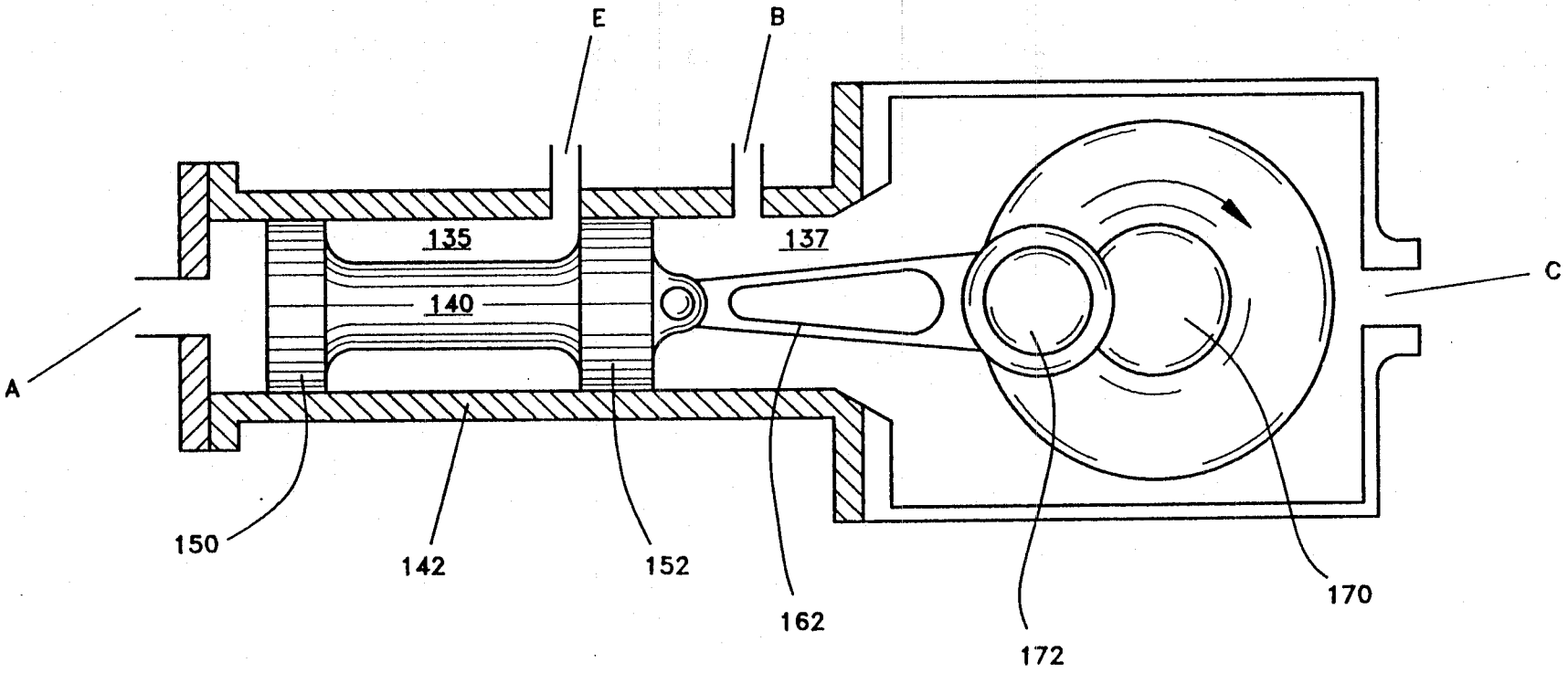
FIG. 12 shows an alternate embodiment of a spool-type piston of the present invention.

FIG. 12 shows an alternate embodiment of a piston-cylinder arrangement of the present invention. Instead of the multi-spool arrangement described above, the piston 140 utilizes a single spool The first sealing member 150 acts as the piston head and hydraulic fluid through port A acts upon the first sealing member 150 to force the piston 140 down on the downstroke. The second sealing member 152 creates the chamber 135 which cooperates with port E. Port C provides hydraulic fluid to chamber 137 and port B alternatively communicates with either chamber 135 or 137 depending on the location of the second sealing member 152 during the movement of the piston 140. The reciprocating motion of the piston 140 is translated to rotary motion for the driveshaft (not shown) by means of the arm 162, the connecting rod journal 172 and the crankshaft 170.

This single spool arrangement of the piston and cylinder can be used when the hydraulic fluid used in the system is oil, which serves the additional purpose of lubricating the moving parts. Typical uses of this engine are in winches or in the ocean-powered power plant described below.

Figure 13:
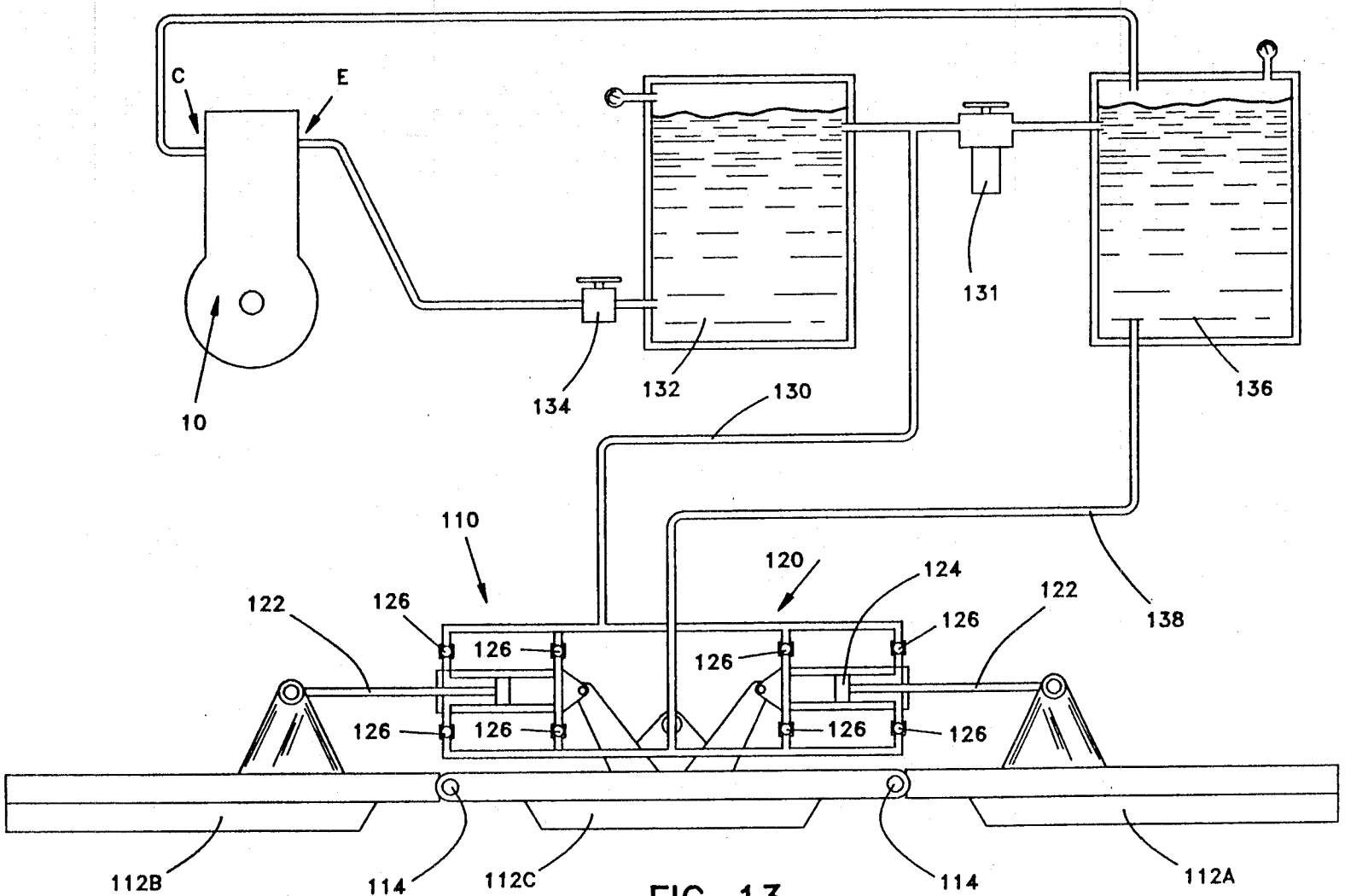
FIG. 13 shows a schematic representation of an engine of the present invention connected with a source of fluid pressure to operate the engine.

FIG. 13 shows an hydraulic power plant arrangement that utilizes waves from a large body of water to pump fluid into a pressurized fluid tank that acts as a reservoir to store fluid under pressure. The pressurized fluid in the tank is then available to deliver fluid to any of the various hydraulic engine embodiments of the present invention.

A pontoon system 110 is positioned in a large body of water where it is expected waves will occur. The pontoon system 110 comprises multiple pontoons 112 pivotally journalled end to end by means of appropriate journal connections 114. The central pontoon 112C is provided with a piston and cylinder pump arrangement 120. A piston rod 122 is connected to an adjoining end pontoon 112A so that as the end pontoon 112A floats up and down on the waves and pivots in relation to the central pontoon 112C, the piston rod 122 will move forward and backward causing fluid in front of the piston head 124 to be pumped through the conduits of the pump arrangement 120. The direction of flow of the fluid is shown by the arrows on FIG. 13. Check valves 126 are provided at appropriate locations in the conduits to ensure that the flow of fluid only goes in the correct direction.

The fluid under pressure flows through inlet line 130 into holding tank 132. When valve 134 is opened, this fluid in holding tank 132 becomes the source of fluid pressure that enters the various cylinders of the hydraulic engine 10 through ports E. After work is performed by this fluid resulting in the ultimate turning of the driveshaft on the engine 10, fluid leaving the hydraulic engine 10 through ports C is returned to a second holding tank 136. Fluid from the second holding tank 136 is returned by return line 138 to the pump arrangement 120 for reuse in the pistons connected to the pontoons 112. The pressure in the first holding tank 132 and the second holding tank 136 can be balanced and adjusted through use of the common regulator valve 131 which fluidly communicates with each tank.

As an alternative embodiment to the pump arrangement 120, additional pistons can be provided oriented in a vertical direction to take advantage of the vertical movement of the pontoons 112. Furthermore, the pump arrangement can be designed with multiple interconnected pistons to take advantage of all the movements of the pontoons 112 regardless of the direction of movement. Thus even the slightest movement of the surface of the body of water would result in pontoon movement which can be used to pump fluid to the pressurized fluid tanks 132 and 136.

The power plant shown in FIG. 13 can be used as a source of electricity. The hydraulic engine 10 and the pressurized fluid tanks 132 and 136 can be constructed on the shore adjoining a body of water. The pontoons 112 and the pump arrangement 120 are located on the body of water and the inlet line 130 and the return line 138 connect the onshore equipment with the equipment floating on the body of water. Movement of the body of water in the form of waves or tides causes movement of the pontoons which is translated into fluid pumped into the reservoirs 132 and 136. This source of fluid pressure powers the hydraulic engine 10. The work realized from the driveshaft of the engine 10 can be used to operate an electrical generator.

The hydraulic engine of the present invention can be made of almost any size desired depending on the power needs of the user. If the wave or tidal forces are strong enough and the pontoon system is carefully constructed, it is theoretically possible to generate enough work from the driveshaft 22 to power electric generators of sufficient size to provide electricity to a large number of inhabitants of a city. At the other end of the scale, even small tidal variations or small wave movements would nevertheless be sufficient to generate the power necessary to operate a winch or to provide electrical power to any type of watercraft.

While the invention has been illustrated with respect to several specific embodiments thereof, these embodiments should be considered as illustrative rather than limiting. For example, it is possible to use the hydraulic engine of the present invention to power a vehicle. It is contemplated that a small one cylinder engine can be used as a source of power to turn a pump to pump fluid into an hydraulic engine of the type described above to produce power. The driveshaft of the hydraulic engine would connect to the power train of the vehicle to provide power to the wheels and the rest of the operating system of the vehicle.

Various modifications and additions may be made and will be apparent to those skilled in the art. Accordingly, the invention should not be limited by the foregoing description, but rather should be defined only by the following claims.

What is claimed is:

1. An engine comprising:

a) plurality of cylinders each containing a piston disposed therein for reciprocating movement, b) a crankshaft connected to one end of each piston, c) a drive shaft connected to an end of the crankshaft, d) a source of pressurized fluid connected by conduits to each cylinder, e) each piston comprising:

1) a first sealing member acting as the piston head, 2) a second sealing member located along the length of the piston whereby an upper chamber is defined between the first sealing member and the second sealing member, 3) a third sealing member located along the length of the piston whereby a middle chamber is defined between the second sealing member and the third sealing member, and 4) a fourth sealing member located along the length of the piston and acting as the bottom of the piston whereby a bottom chamber is defined between the third sealing member and the fourth sealing member, f) a first port associated with each cylinder for delivering pressurized fluid to the head of the piston, g) a second port associated with each cylinder for removing pressurized fluid selectively from the upper chamber or for delivering pressurized fluid to the middle chamber, h) a third port associated with each cylinder for removing pressurized fluid from the middle chamber, i) a fourth port connected to the source of pressurized fluid and associated with each cylinder for delivering pressurized fluid to the upper chamber, and j) an arm connected at one end thereof to the bottom of the piston and connected at the other end thereof to the crankshaft whereby the reciprocating movement of each piston is translated into rotary movement of the driveshaft through the crankshaft.

2. The engine as described in claim 1 wherein the plurality of cylinders is a multiple of four.

3. The engine as described in claim 2 wherein the crankshaft has four connecting rod journals disposed at locations 90° apart about the circumference of the crankshaft and each arm is connected to the crankshaft through a connecting rod journal.

4. The engine as described in claim 1 wherein each first port on a first cylinder is connected by a conduit with a second port on a second cylinder whereby pressurized fluid is removed from the upper chamber of the second cylinder through the second port and delivered through the first port to the piston head of the first cylinder.

5. The engine as described in claim 1 wherein each second port on a first cylinder is connected by conduit with a first port on a third cylinder whereby pressurized fluid is removed from the upper chamber of the first cylinder and delivered to the piston head of the third cylinder.

6. The engine as described in claim 1 wherein each third port on the plurality of cylinders are interconnected by a manifold for returning pressurized fluid to the source of the pressurized fluid.

7. The engine as described in claim 1 wherein each fourth port on the plurality of cylinders are interconnected by a manifold for delivering pressurized fluid from the source of the pressurized fluid to the cylinders.

8. The engine as described in claim 1 wherein a) each first port on a first cylinder is connected by a conduit with a second port on a second cylinder whereby pressurized fluid is removed from the upper chamber of the second cylinder through the second port and delivered through the first port to the piston head of the first cylinder, b) each second port on a first cylinder is connected by conduit with a first port on a third cylinder whereby pressurized fluid is removed from the upper chamber of the first cylinder and delivered to the piston head of the third cylinder, c) each third port on the plurality of cylinders are interconnected for returning pressurized fluid to the source of the pressurized fluid, and d) each fourth port on the plurality of cylinders are interconnected for delivering pressurized fluid from the source of the pressurized fluid to the cylinders.

9. The engine as described in claim 8 further including a pair of fifth ports for delivering and removing lubricating fluid from the lower chamber.

10. The engine as described in claim 1 further including a pair of fifth ports for delivering and removing lubricating fluid from the lower chamber.

11. A power plant comprising:

a) a source of pressurized fluid, b) a first conduit for delivering pressurized fluid from the source to an engine, c) a second conduit for returning pressurized fluid from the engine to the source, and d) an engine comprising:

1) a plurality of cylinders each containing a piston disposed therein for reciprocating movement, 2) a crankshaft connected to one end of each piston, 3) a drive shaft connected to an end of the crankshaft, 4) each piston comprising:

(a) a first sealing member acting as the piston head, (b) a second sealing member located along the length of the piston whereby an upper chamber is defined between the first sealing member and the second sealing member, (c) a third sealing member located along the length of the piston whereby a middle chamber is defined between the second sealing member and the third sealing member, and (d) a fourth sealing member located along the length of the piston and acting as the bottom of the piston whereby a bottom chamber is defined between the third sealing member and the fourth sealing member, 5) a first port associated with each cylinder for delivering pressurized fluid to the head of the piston, 6) a second port associated with each cylinder for removing pressurized fluid selectively from the upper chamber or for delivering pressurized fluid to the middle chamber, 7) a third port associated with each cylinder for removing pressurized fluid from the middle chamber, 8) a fourth port connected to the source of pressurized fluid and associated with each cylinder for delivering pressurized fluid to the upper chamber, and 9) an arm connected at one end thereof to the bottom of the piston and connected at the other end thereof to the crankshaft whereby the reciprocating movement of each piston is translated into rotary movement of the driveshaft through the crankshaft.

12. The power plant of claim 11 wherein the source of pressurized fluid is a pressurized fluid tank.

13. The power plant of claim 11 further including a pontoon system disposed on a body of water and a pump arrangement mounted on the pontoon system for pumping fluid under pressure to the pressurized fluid tank.

14. The power plant of claim 13 wherein the pontoon system comprises a plurality of pontoons pivotally journalled together whereby any movement of the body of water is translated by the pontoons into the pump arrangement so that fluid in the pump arrangement is pumped into the pressurized fluid tank.

15. The power plant of claim 11 further including a fifth port for delivering and removing a lubricating fluid from the lower chamber.

16. An engine comprising:

a) a plurality of cylinders each containing a piston disposed therein for reciprocating movement, b) a crankshaft connected to one end of each piston, c) a drive shaft connected to an end of the crankshaft, d) a source of pressurized fluid connected by conduits to each cylinder, e) each piston comprising:

1) a first sealing member acting as the piston head, 2) a second sealing member acting as the bottom of the piston whereby an upper fluid chamber is defined between the first sealing member and the second sealing member, f) an arm connected at one end thereof to the bottom of the piston and connected at the other end thereof to the crankshaft, g) a lower fluid chamber formed by the bottom of the piston and a housing surrounding the arm and the crankshaft, h) a first port associated with each cylinder for delivering pressurized fluid to the head of the piston, i) a second port associated with each cylinder for removing pressurized fluid selectively from the upper chamber or delivering pressurized fluid to the lower chamber, i) a third port for removing pressurized fluid from the lower chamber, and j) a fourth part connected to the source of pressurized fluid and associated with each cylinder for delivering pressurized fluid to the upper chamber whereby the reciprocating movement of each piston is translated into rotary movement of the drive shaft through the crankshaft.

17. The engine as described in claim 16 wherein the plurality of cylinders is a multiple of four and a) each first port on a first cylinder is connected by a conduit with a second port on a second cylinder whereby pressurized fluid is removed from the piston head of the first cylinder and delivered through the second port to the lower chamber of the second cylinder, b) each second port on a first cylinder is connected by a conduit with a first port on a third cylinder whereby pressurized fluid is removed from the upper chamber of the first cylinder and delivered to the piston head of the third cylinder, c) each third port on the plurality of cylinders are interconnected for returning pressurized fluid to the source of the pressurized fluid, and d) each fourth port on the plurality of cylinders are interconnected for delivering pressurized fluid from the source of the pressurized fluid to the cylinders.

18. The engine as described in claim 17 wherein the crankshaft has four connecting rod journals disposed at locations 90° apart about the circumference of the crankshaft and each arm is connected to the crankshaft through a connecting rod journal.

* * * * *